United States Patent [19]

Grostick et al.

[11] 4,017,024

[45] Apr. 12, 1977

[54] STACK DAMPER CONTROL ARRANGEMENT

[75] Inventors: Martin Coiner Grostick; Thomas Edward Hayes, both of Goshen, Ind.

[73] Assignee: Johnson Controls, Inc.

[22] Filed: Dec. 3, 1975

[21] Appl. No.: 637,322

[52] U.S. Cl. ..... 236/16; 236/78 C; 110/163; 318/468

[51] Int. Cl.[2] ..... F24D 5/00

[58] Field of Search ..... 236/16, 78 C, 73; 126/285; 110/163; 251/134; 318/468

[56] References Cited

UNITED STATES PATENTS

| | | | |
|---|---|---|---|
| 2,155,642 | 4/1939 | Dewey | 236/16 |
| 2,172,487 | 9/1939 | Wasserlein, Jr. | 236/78 C |
| 2,226,510 | 12/1940 | Grant | 236/16 UX |
| 2,654,061 | 9/1953 | Gille | 318/468 V |

*Primary Examiner*—William E. Wayner
*Attorney, Agent, or Firm*—Johnson, Dienner, Emrich & Wagner

[57] ABSTRACT

A stack damper control arrangement for use in a heating system including a furnace having a fuel-fired burner apparatus and a vent stack for conducting combustion products away from the burner apparatus and a damper plate pivotally mounted within the stack and movable between a fully open and a fully closed position, includes a reversible drive motor which is energizable in response to a request for heat to drive the damper plate to the open position, a first limit switch operated when the damper plate reaches the open position to effect the deenergization of the motor, the motor being reenergized at the end of the heating cycle to drive the damper plate to the closed position, and a second limit switch operated when the damper plate reaches the closed position to effect the deenergization of the motor. The damper control arrangement is described with reference to a heating system including a gas fired burner and redundant gas valves wherein operation of a first one of the gas valves is effected through operation of the first limit switch and thus is conditional upon the damper being fully open, and wherein the supply of fuel to the second valve is conditional upon the operation of the first valve.

15 Claims, 7 Drawing Figures

70
70'
68
93
116
86
74
71
79
130
46
45
44
43
32
82
81
69
60
33
58
55
57
104
59
105
62
64
61
63
24
65
68
92
116
70
71
58
67
115
80
76
79
73
75
31
73
75
78
30
77

STACK DAMPER CONTROL ARRANGEMENT

BACKGROUND OF THE INVENTION

1. Field of the Invention

This invention relates to heating systems including furnaces having fuel-fired burners, and, more particularly, to a control arrangement for motor actuated stack dampers and fuel supply apparatus for such systems.

2. Description of the Prior Art

Heating systems employing furnaces having fuel-fired burners require a vent stack to conduct combustion products away from the burner. Automatically controlled stack dampers are generally used in the ventilation stacks to permit the stacks to be closed when the furnace is not operating to minimize heat losses when the furnace is not operating. However, for safe operation, it is necessary that the stack damper be open in advance of each operation of the burner and that the damper be maintained open for a short time following each operation of the burner to allow volatiles to be purged from the furnace following each operation. Accordingly, systems in which automatic dampers are used generally include a control arrangement which provides an interlock between the damper control mechanism and fuel supply apparatus of the system to assure that the damper is fully open before the burner operates and is maintained open for a short time after the completion of the operation of the burner.

One such arrangement is disclosed in the U.S. Pat. No. 3,010,451 to Hodgins in which a primary burner control is conditional on and subsequent to the opening of the damper. A damper drive motor is energized in response to a call for heat to drive the damper to an open position. A normally open microswitch, which is connected in series with the burner control circuit, is operated to complete the burner circuit when the damper reaches the fully open position. At the end of the run, the damper drive motor is deenergized, and a bias spring permits the damper to return to the closed position. Movement of the damper from the fully open position permits the microswitch to open, interrupting the burner circuit. A time lag is provided between the interruption of the burner circuit and the closing of the damper to allow volatiles to be purged from the furnace following operation of the burner.

One common feature of known prior art systems in which control circuits for the burner are interlocked with damper control circuits is that the dampers are driven to and maintained in the open position through use of a motor or solenoid and returned to a closed position through the action of a spring bias mechanism when the motor or solenoid is deenergized. In such systems, the motor or solenoid requires continuous energization when the burner is operating to maintain the damper in the open position, requiring continual power usage while the furnace is operating. Also, in the event of a momentary power loss, the damper is automatically returned to a fully closed position, and upon restoration of power, the damper must be driven to the open position before a heating cycle can be initiated.

Moreover, a safety standard recently established by the American Gas Association requires that stack dampers be biased in such a manner that the damper returns to a fully open position upon the loss of power. Accordingly, modification of known damper control units to meet such standard would require that the drive motor or solenoid be energized in a stalled condition whenever the furnace is off. Such requirement not only results in large power losses, but also decreases the lifetime of the motor or drive solenoid.

Therefore, it would be desirable to provide an automatic damper control arrangement for use in a heating system which minimizes power consumption. It would also be desirable to have a motor driven damper apparatus for use in a heating system which is interlocked with fuel supply apparatus of the system, and which prevents operation of the fuel supply apparatus whenever the damper is in a position other than a fully open position.

SUMMARY OF THE INVENTION

It is therefore an object of the present invention to provide a new and improved power actuated stack damper for use in a furnace installation or the like.

Another object of the invention is to provide a control arrangement for a damper apparatus which provides bidirectional drive for a motor permitting a damper to be driven both from a closed to an open position and from an open to a closed position.

Yet another object of the invention is to provide a stack damper control arrangement for a heating system including a motor actuated stack damper apparatus which minimizes power consumption.

A further object of the invention is to provide a heating system employing redundant fuel valves which supply fuel to a burner apparatus of the furnace and which includes a motor actuated damper apparatus which is interlocked with the fuel valves to permit operation of the fuel valves only when the damper is in a fully open position.

These and other objects are achieved by the present invention which has provided a stack damper control arrangement for use in a heating system including a furnace having a fuel-fired burner apparatus and a vent stack for conducting combustion products away from the burner apparatus. The stack damper control arrangement comprises a damper plate pivotally mounted within the vent stack, the damper plate being normally maintained at a first position to close the vent stack and movable to a second position to open the stack. Drive means, including a motor circuit, provides bidirectional drive for a reversible motor which has a shaft operatively coupled to the damper plate. The motor is energizable to drive the damper plate between the first and second position in response to a request for heat. A first limit switch means, operated when the damper plate reaches the open position, effects deenergization of said motor. At the end of the heating cycle, the motor is reenergized to drive the damper plate to the closed position and a switch means, operated when the damper plate is returned to the first position, effects deenergization of the motor.

Thus, the stack damper control arrangement provided by the present invention provides bidirectional drive for the motor, permitting the damper plate to be driven both to the open position and to the closed position. The first and second limit switch means permit the motor to be deenergized whenever the damper plate reaches either the fully open or the fully closed position. Accordingly, power drive to the motor is eliminated for all times other than when the damper is required to open or close. This greatly enhances motor life since the motor is energized for only a few seconds during each heating cycle and is never required to operate in a stalled condition. More specifically, during a normal nine month heating season, assuming a two second run time per cycle, the motor is required to run approximately 0.5 percent of the on time for the furnace. In other known stack damper arrangements, such as the one disclosed in the Hodgins patent referenced above, modified to meet the AGA standard, the motor would be energized in a stalled condition approximately 63% of the time, to maintain the damper closed when the furnace is off.

In accordance with the present invention, the stack damper motor control circuit is interlocked with the fuel supply apparatus for the furnace to prevent enabling of the fuel supply apparatus unless the damper is open. For example, in a gas heating system of the pilot ignition type, the operation of a pilot valve of the system is controlled by the first limit switch means and thus is conditional upon the damper plate being operated to the fully open position as noted above. The operation of the first limit switch means requires the damper to be moved to the open position and thus an energizing circuit is made to the pilot gas valve only when the damper is open.

If the motor fails with the damper in the open position, full control of the ignition system, including energizing of the pilot gas valve is returned to the thermostat as if the damper was not in the system. Since the motor is connected in the thermostat circuit only when the damper is opening or closing, a standard thermostat with heat anticipation can be set in accordance with a gas valve amperage rating only, with no effect on the heat anticipation of the unit.

In accordance with a feature of the invention, the operation of the first and second limit switch means is effected by operating members which are carried by a gear sector driven by the motor which also effects positioning the damper plate. The first limit switch means includes a pair of contact members of a spring material one of which is offset relative to the other forming a gap therebetween which prevents the contacts from touching one another should one or both of the contacts fracture or take a permanent set. Connection between the two contact members is made by a bridge contact carried by the gear sector. Also, should the motor fail when the damper plate is in any position other than the full open position, where the contact members are bridged by the bridge contact, power cannot be applied to the pilot valve of the heating system. Thus, the limit switch means which control the energization of the pilot valve inherently affords a fail-safe design which precludes inadvertant operation of the valve.

In accordance with a further feature of the invention, the heating system employs redundant gas valves for supplying fuel to a pilot outlet and to a main burner. Accordingly, fuel for the main burner also passes through the pilot valve, and whenever the pilot valve is deenergized the fuel supply to the main valve is interrupted. Accordingly, the use of redundant valves, which cannot be manually operated, obviates the possibility of the burner operating with the stack damper in a position other than the full open position.

DESCRIPTION OF A PREFERRED EMBODIMENT

Figure 1:
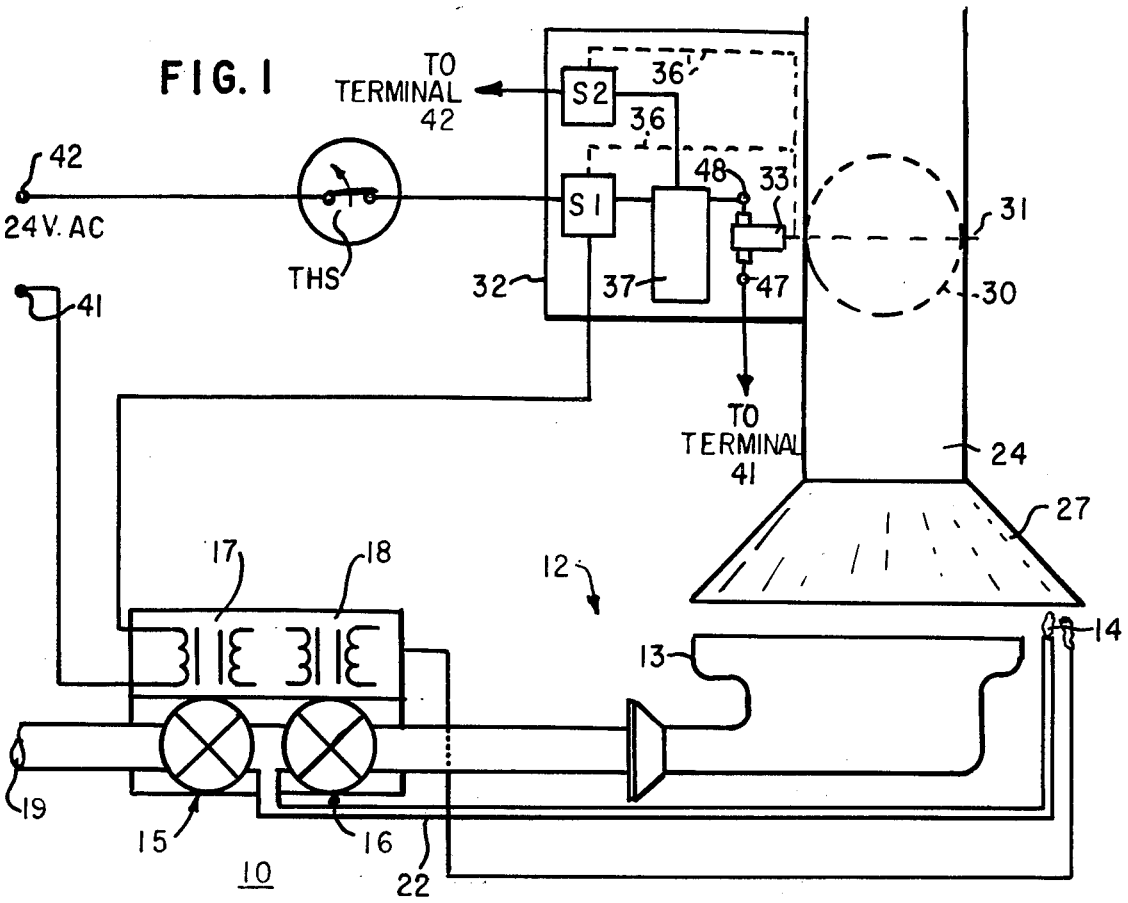
FIG. 1 is a simplified representation of a heating system employing a stack damper control arrangement provided by the present invention.

Referring to FIG. 1, there is shown a simplified representation of a heating system 10 employing the stack damper control arrangement provided by the present invention. The heating system 10 includes a gas furnace, indicated generally at 12, having a main burner apparatus 13 and a pilot outlet 14. A pilot gas valve 15 and a main gas valve 16, having associated operating solenoids 17 and 18, respectively, are operable to supply fuel to the pilot outlet 14 and the main gas burner 13, respectively. When the pilot valve 15 is operated, fuel is supplied from a fuel inlet 19 to the pilot outlet 14 over a fuel line 22 for ignition by a suitable ignition means (not shown) to establish a pilot flame. When a pilot flame is established, the main valve 16 is operated under the control of a suitable control circuit (not shown) to permit gas to flow to the main burner 13. In the exemplary embodiment, the pilot valve 15 and the main valve 16 are redundant valves, of the type shown in the coending U.S. application Ser. No. 630,166 of Russell B. Matthews entitled "Slow Opening Gas Valve", which was filed Nov. 10, 1975. Fuel for the main burner 13 flows through both the pilot valve 15 and the main valve 16 and thus, the fuel supply to the main burner 13 is interrupted whenever the pilot valve 15 is closed.

For the purpose of venting combustion products away from the burner, the furnace 12 includes a vent stack 24 shown in FIG. 1 to extend vertically from a draft hood 27 which overlies the main burner 13 and the pilot burner 14 to funnel exhaust gases to the stack 24.

A damper plate 30, which is shown in a fully open position in FIG. 1, is pivotally mounted within the stack 24 by way of a shaft 31 for movement between the open position and a closed position. The shaft 31 is driven by a stack damper control apparatus 32 which includes a reversible motor 33, such as the Barber-Colman Model FYQM33600-12, having an associated motor control circuit 37, which permits the damper plate 30 to be driven between a fully open and a fully closed position.

Power for energizing the motor 33 and the valves 15 and 16 is supplied to the system 10 over input terminals 41 and 42 which are connectable to a 24 VAC source. The motor 33 has a first terminal 47 connected to terminal 41 and a second terminal 48 connectable to terminal 42 over the motor control circuit 37 and thermostat contacts THS. The motor is energized in response to operation of the thermostat contacts THS which are shown in FIG. 1 as being closed as during a heating cycle. The closing of contacts THS permits 24 VAC to be extended to the motor control circuit over a limit switch S1. When the damper plate 30 is closed, switch S1 completes an energizing circuit for the motor 33 over the motor control circuit. Switch S1 is mechanically linked to the motor drive, as indicated by the broken line 36, and when the motor 33 is energized to rotate the damper plate 30, the switch S1 is operated to deenergize the motor 33 and to energize the pilot valve solenoid 17 when the damper plate 30 has been moved to the fully open position. However, when the damper plate 30 is in the closed position, switch S1 is opened, thereby preventing operation of the pilot valve 15. Thus, switch S1 provides an interlock between the damper control apparatus 32 and the pilot valve 15 and prevents operation of the pilot valve 15 unless the damper 30 is fully open. It should also be noted that whenever the pilot valve 15 is closed, fuel supply to the main valve 16 is interrupted and thus, no fuel is supplied to the main burner 13.

A further limit switch S2, shown connected between input terminal 42 and the motor control circuit 37 is also mechanically linked to the motor 33, as indicated by the broken line 36', and is operable to deenergize the motor 33 when the damper plate 30 is driven from the open position to the closed position.

Figure 2:
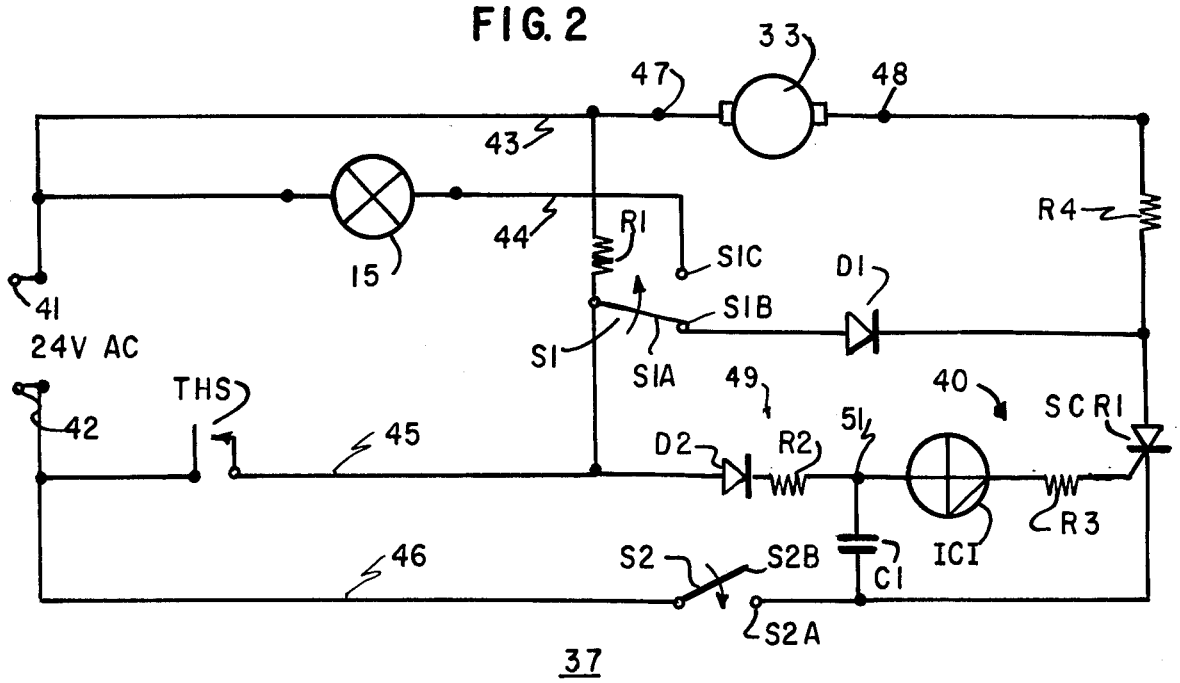
FIG. 2 is a schematic circuit diagram for a stack damper motor control circuit for the system of FIG. 1.

The manner in which the motor control circuit 37 provides reversible drive for the motor 33 and the operation of the limit switches S1 and S2 is best shown by referring to the schematic circuit diagram for the motor control circuit 37 shown in FIG. 2, which illustrates the condition of switches S1 and S2 when the damper plate 30 is in the closed position.

Referring to FIG. 2, limit switch S1 comprises a switch arm S1A which is normally operated to engage a contact S1B when the damper plate 30 is in the closed position to provide a first energizing path for the motor 33 when the thermostat contacts THS are closed. When the damper 30 is in the open position, switch arm S1A is disengaged from contact S1B, opening the energizing path for the motor 33 which is thus deenergized and switch arm S1A engages contact S1C to complete the path to the pilot valve solenoid 17 to operate the pilot valve 15.

Switch S2 includes a switch contact S2A and switch arm S2B which is normally disengaged from contact S2A when the damper plate 30 is closed and which engages contact S2A when the damper plate 30 is moved away from the closed position to prepare a second energizing path for the motor 33.

Considering the motor control circuit 37 in more detail, input terminal 41 is connected over a conductor 43 to one terminal 47 of the motor 33. The other inut terminal 42 is connected over the normally open thermostat contacts THS, a conductor 45 and switch arm S1A and contact S1B of switch S1, and over a diode D1 and a resistor R4 to a second terminal 48 of the motor 33, to provide the first energizing circuit for the motor 33, which is thus energized when the thermostat contacts THS are operated to closed. When the motor 33 is energized, over the first energizing path, the shaft of the motor is driven in a first direction to rotate the damper plate 30 towards the open position.

When the damper plate 30 is in the fully open position, switch arm S1A is moved out of engagement with contact S1B interrupting the first energizing path for the motor 33, and into engagement with contact S1C, which is connected over conductor 44 to one side of solenoid 17, the other side of which is connected to input terminal 41 of the circuit 37. Accordingly, when switch S1 operates, the pilot valve 15 is operated.

Switch S2 effects the deenergization of the motor 33 when the damper plate 30 is driven from the open position to the closed position. The motor control circuit 37 includes a switching circuit 40, including a silicon controlled rectifier device SCR1 and a controlled switching device ICI, which may be a silicon unilateral switch such as the General Electric Type 2N4988, which provide the second energizing path for the motor 33 for reversing the direction of rotation of the motor shaft to rotate the damper plate 30 to a closed position. The device SCR1 is connected in a series circuit with resistor R4 between terminal 48 of the motor 33 and contact S2A of switch S2, switch arm S2B being connected over a conductor 46 to terminal 42 of the motor control circuit 37. An enabling signal is provided to the gate of the device SCR1 in response to conduction of the device ICI which is connected in series with a resistor R3 between point 51 and the gate of the device SCR1. The operation of the device ICI is controlled by a timing circuit 49 including a capacitor C1 which is connected in a series charging path which extends from input terminal 41 of the circuit 37, over a resistor R1, a diode D2, and a resistor R2 to a point 51 and over the capacitor C1 to contact S2A of switch S2.

Switch S2 is open when the damper plate 30 is in the closed position, with switch arm S2B disengaged from contact S2A. Switch arm S2B is moved to engage contact S2A when the motor 33 is energized to move to damper plate 30 toward the open position, preparing the second energizing path for the motor 33, which is interrupted at such time by the normally non-conducting device SCR1. When the thermostat contacts THS are closed, the charging path for capacitor C1 is inhibited preventing operation of the device SCR1. However, when the heating demand is met, the thermostat contacts THS open, and capacitor C1 is permitted to charge raising the potential at point 51. Also, when contacts THS open, the pilot valve is deenergized interrupting the supply of fuel to the pilot outlet 14 and the main burner 13. When the charging capacitor C1 has charged to a value of approximately 8 volts, which corresponds to the turn on level for the device ICI, the device ICI conducts, discharging capacitor C1 into the gate of device SCR1 which then conducts, energizing motor 33 to effect rotation in the opposite direction to return the damper plate 30 to the closed position. The charging of capacitor C1 provides a time delay of approximately 4 seconds before the motor 33 is energized and after interruption of fuel supply to the burner apparatus thereby permitting the burner flame to be extinguished and exhaust gases removed from the burner before the damper plate 30 is closed.

Figures 3, 3B:
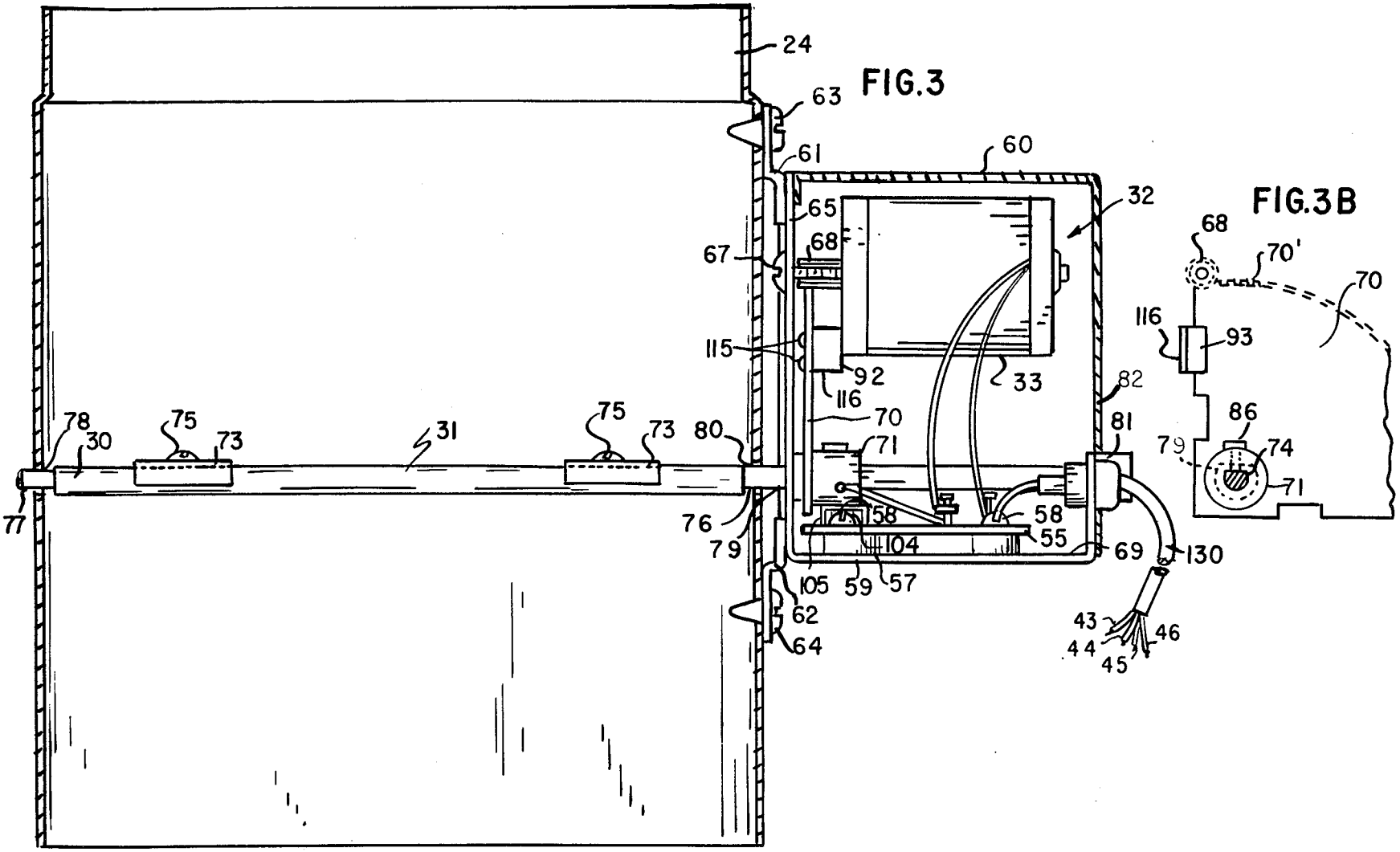
FIG. 3 is a side elevation view, partially in section, showing a damper plate mounted in a vent stack, and the stack damper control apparatus provided by the present invention.
FIG. 3B illustrates the drive linkage between a stack damper drive motor shaft and a stack damper shaft of the apparatus shown in FIG. 3.

In accordance with the present invention, the limit switches S1 and S2 are operated by the damper control apparatus 32 through a pair of operating members, including operating member 92 shown in FIG. 3, which are carried by a gear sector 70 which is driven by the motor 33. The switches S1 and S2 are carried by a printed circuit board 55 which locates the switches S1 and S2 adjacent the gear sector 70.

Considering the motor control apparatus 32, the motor control apparatus 32, the motor 33 is mounted within a housing 60 which has suitable mounting lugs 61 and 62 secured to the housing 60 which are attached to the stack 24 by suitable fasteners, such as sheet metal screws 63 and 64.

The motor 33 is mounted within the housing and is attached to a side wall 65 of the housing 60 by way of a pair of mounting bolts 67, one of which is shown in FIG. 3. The The motor 33 has a pinion 68, which engages gear teeth 70′ of the gear sector 70, to drive the gear sector 70 for effecting rotation of the damper shaft 31 which carries the damper plate 30. The shaft 31 is generally rectangular in shape and is rounded at one end 77 where it extends through an aperture 78 in the vent stack 24, and at an intermediate point 76 where the shaft 31 extends through a further aperture 80 in the vent stack 24 which is of a larger diameter then the flat of the shaft 31, permitting insertion of the shaft 31 into the stack 24. The shaft extends through an aperture 79 in the side wall 65 of the housing 60, which serves as a bearing point and through a gear collar 71, which is attached to the gear sector 70, the shaft 31 extending through the housing 60 with its other end engaging a suitable bearing 81 which is mounted in the opposing side wall 82 of the housing 60.

Figure 3A:
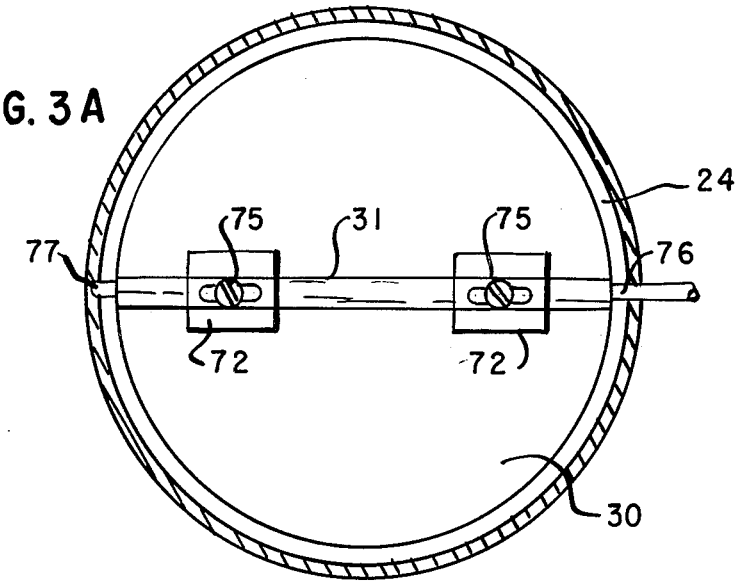
FIG. 3A is a plan view of the damper plate assembly, shown mounted within the vent stack.

Damper plate 30, which is shown operated to a closed position in FIG. 3, has slotted rectangular mounting tabs 72, shown best in FIG. 3A, which facilitate mounting of the circularly shaped damper plate 30 on the rectangular shaft 31 by set screws 75 which tightened to engage the shaft 31 to prevent side motion and vibration noise.

As best shown in FIG. 3B, a flat 74 on the damper shaft 31 mates with the gear collar 71. A set screw 86 secures the shaft 31 to the gear collar 71. The gear collar 71 has a D flat 79 which mates with a D slot 83 in the gear sector 70, which is shown more clearly in FIG. 4.

Figure 4:
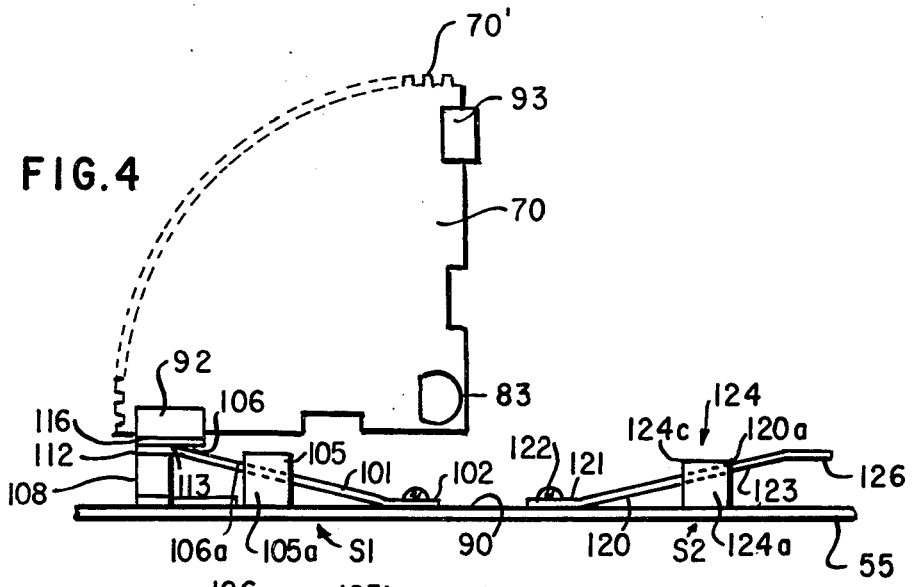
FIG. 4 is a simplified representation of limit switches and associated operating members employed by the control arrangement of the present invention; and, FIG. 5 is a plan view of a printed circuit board which mounts the limit switches and circuit components of the stack damper control circuit shown schematically in FIG. 2.
Figure 5:
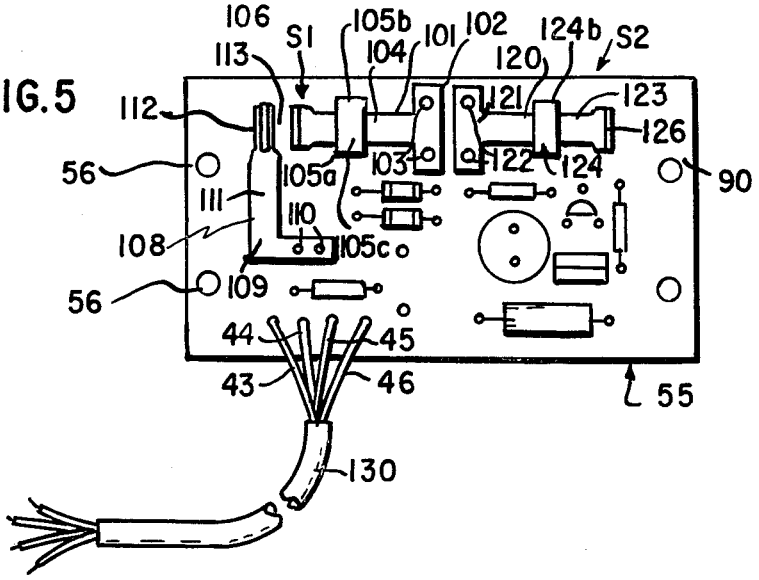

Referring to FIGS. 4 and 5, which shows the details of the limit switches S1 and S2, switch arm S1A of limit switch S1 comprises a resilient leaf spring 101 which has a base portion 102 secured to an upper surface 90 of the printed circuit board 55 by suitable fastening means such as rivets 103. Leaf spring 101 has an arm portion 104 extending angularly upward from the base portion 102 and between upstanding leg portions 105*a* and 105*b* of an inverted U-shaped contact 105, which support a contact portion 105*c* above surface 90. The arm portion 104 of the leaf spring member 101 terminates in a contact portion 106, and the portion 106*a*, intermediate the base portion 102 and contact portion 106, is disposed adjacent contact portion 105*c* of the fixed contact 105. Contact 105 comprises contact S1B. Contact S1C comprises a further resilient leaf spring member 108 which has a base portion 109 secured to surface 90 by rivets 110 and an upwardly extending arm portion 111 which extends generally perpendicular to, but offset from spring member 101, permitting a contact portion 112 to be spaced apart from contact portion 106 providing a significant gap 113 there between which prevents the two contact portions 112 and 106 from touching should one or both of the contacts fracture or take a permanent set.

As shown in FIG. 4, operating member 92 which is carried by the gear sector 70 for the purpose of actuating switch S1, has a base portion secured to the gear sector 70 by screws 115, shown in FIG. 3, and a bridge contact portion 116 of an electrically conducting material. Whenever the damper plate is closed, arm portion 104 engages contact 105, providing the circuit path between switch arm S1A and contact S1B as shown in FIG. 2. When the damper plate is open, the gear sector 70 is positioned as shown in FIG. 4, and leaf spring member 101 is disengaged from contact 105, and contact portion 116 of operating member 92 bridges the gap 113 between the contact portions 106 and 112 to complete the energizing circuit to the pilot valve 15.

Switch S2 comprises a resilient leaf spring member 120, which comprises switch arm S2B, having a base portion 121 secured to the printed circuit board 55 by rivets 122 and an arm portion 123 extending upwardly at an angle to the surface 90 of the printed circuit board 55 between upstanding leg portions 124*a* and 124*b* of an inverted U-shaped contact 124 which support a contact portion 124*c* above surface 90. Contact member 124 comprises contact S2A. Switch arm S2B is operated by an operating member 93 carried by the gear sector 70 displaced 90° from operating member 92 along the periphery of gear sector 70, which disengages the contact portion 120*a* from the contact 124 when the damper plate 30 is in the closed position. When the motor 33 operates to rotate the gear sector 70 to move the damper plate to the open position as shown in FIG. 4, the operating member 93 is moved out of engagement with arm portion 123 of leaf spring member 120, permitting the the portion 120*a* of spring member 120, which is intermediate the base portion 121 and the end 126, to engage contact 124 such that switch S2 is operated to a closed position.

Referring to FIG. 3, the printed circuit board 55, which also carries the components of the control circuit 37 as shown in FIG. 5, is mounted within the housing 60 on a lower surface 69 by way of suitable mounting devices including spacers 57 and screws 58 which pass through apertures 56 in the board 55 and engage threaded apertures 59 in the surface 62. The end contact portions 106, 112 and 126 of the leaf spring members 101, 108 and 120 extend adjacent the gear sector 70 to permit engagement by the operating members 92 and 93 which are carried by the gear sector 70. As shown in FIG. 3, a power cord 130, comprised of conductors 43–46, extends through wall 82 of housing 60 to permit connection of conductors 43–46 to the board 55.

OPERATION

The damper plate 30 is normally closed when the furnace is off, shutting the vent stack 24 to prevent heat loss by minimizing air flow across the heat exchanger of the furnace to the stack 24. Referring to FIG. 2, in response to a request for heat, thermostat contacts THS close, completing the first energizing circuit for the motor 33 from terminal 42 over the thermostat contacts THS, switch S1, including contact arm S1A and contact S1B, diode D1, resistor R4 and the motor, to input terminal 41. Accordingly, the motor is energized to drive the gear sector 70 in one direction, (counter-clockwise when the gear sector 70 is viewed in FIG. 4) to rotate the damper plate 30 toward an open position.

Referring to FIG. 4, as the motor 33 drives the gear sector 70, operating element 93 is moved out of engagement with leaf spring 120 which moves through its spring resiliency to engage contact member 124, completing a circuit path to the device SCR1 (FIG. 2) and to one side of capacitor C1 over switch S2.

When the gear sector 70 is driven to the position shown in FIG. 4, which corresponds to a full open position for the damper plate 30, operating member 92 engages the contact portion 106 of leaf spring member 101, moving the leaf spring member 101 from engagement with the contact 105. The drive time may be on the order of two seconds. Accordingly, the motor 33 is effectively removed from the thermostat circuit. The conductive portion 116 of operating member 92 also bridges the gap 113 between contact portions 106 and 112 of spring members 101 and 108 to complete an energizing circuit to the pilot valve 15 which then operates to supply fuel to the pilot outlet 14 (FIG. 1) for ignition. Following ignition of the pilot fuel, the main valve 16 is operated by a suitable control circuit supplying fuel to the main burner 13 for ignition by the pilot flame.

When the demand for heat has been met, thermostat contacts THS open the energizing circuit for the pilot valve 15, which then closes, interrupting the supply of fuel to pilot outlet and to the main valve 16, extinguishing the flame at the main burner 13 and at the pilot burner 14. In addition, when thermostat switch contacts THS open, capacitor C1 is charged over the charging path established by operation of switch S2 to raise the potential at point 51. When capacitor C1 has charged to approximately 8 volts, in a time of approximately 4 seconds, switch device ICI is rendered conductive, permitting capacitor C1 to discharge over the device ICI, supplying a gate pulse to the SCR device SCR1 which then conducts to complete the second energizing path for the motor, effecting clockwise rotation of the gear sector 70, and thus damper plate 30, to drive the damper plate 30 to the closed position. As the gear sector 70 rotates clockwise, switch contact operator 92 disengages the leaf spring members 101 and 108, thereby opening the energizing circuit over switch S1 for the pilot valve 15. In addition, leaf spring member 101 reengages contact 105.

When the gear sector 70 has been rotated clockwise to a position which corresponds to the fully closed position for the damper plate 30, operating member 93 engages leaf spring member 120, breaking the contact between the spring member 120 and contact 124, opening switch S2 to deenergize the motor 33 which then remains deenergized until contacts THS reclose to initiate a further heating cycle.

Thus, the motor 33 is energized only when the damper plate 30 is required to be open or closed. This greatly enhances motor life due to the fact that the motor 33 operates only a few seconds for each cycle and is never required to operate in a stalled condition. Moreover, the limit switches S1 and S2 assure that the motor 33 is driven to the maximum position. The motor 33 is energized until the appropriate limit switch (S1 and S2) is operated by the associated operator members 92 or 93 carried by the gear sector which effect deenergization of the motor 33.

Also, operation of the limit switch S1 is required before the pilot valve 15 can be energized. If the motor fails in the open position, the pilot valve 15 operates only when the thermostat contacts THS operate in response to a call for heat. Failure of the motor 33 in any position other than full open position for the damper plate 30 causes power lock-out of the system and since the redundant valves 15 and 16 cannot be manually operated, the possibility of no flame shut down or manual override during power failures is substantially eliminated.

We claim:

1. In a heating system including a furnace having a fuel-fired burner apparatus, fuel supply means operable when energized to supply fuel to said burner apparatus for combustion, a vent stack for conducting combustion products away from said burner apparatus, and a damper plate pivotally mounted within said vent stack, said damper plate being normally maintained at a first position to close said vent stack, and being rotatable to a second position to open said stack, a stack damper control arrangement comprising drive means operatively coupled to said damper plate, control circuit means including a first limit switch operable to provide a first energizing circuit for said drive means, activate means operable in response to a request for heat to connect power to said first energizing circuit for energizing said drive means to effect rotation of said damper plate from said first position to said second position, said first limit switch being operated when said damper plate reaches said second position to interrupt said first energizing circuit to thereby effect the deenergization of said drive means and to complete an energizing path for said fuel supply means, said control circuit means further including a second limit switch and normally disabled switching means, said second limit switch being operated as said damper plate is moved away from said first position to prepare a second energizing circuit for said drive means, said activate means effecting the deenergization of the fuel supply means and the enabling of said switching means when the heating demand has been met to complete said second energizing circuit for energizing said drive means to effect rotation of said damper plate from said second position to said first position, said second limit switch being operated when said damper plate reaches said first position to interrupt said second energizing circuit to thereby effect the deenergization of said drive means.

2. A system as set forth in claim 1, wherein said control circuit means further includes delay means responsive to said activate means when the heating demand has been met to delay the enabling of said swiching means for a predetermined time.

3. In a heating system including a furnace having a fuel-fired burner apparatus, fuel supply means operable when energized to supply fuel to said burner apparatus for combustion, a vent stack for conducting combustion products away from said burner apparatus, and a damper plate carried by a shaft which is pivotally mounted within said vent stack, said damper plate being normally maintained at a first position to close said vent stack and being rotatable to a second position to open said vent stack, a stack damper control arrangement comprising a reversible drive motor having a drive shaft, a gear sector driven by a pinion which is carried by said motor drive shaft, said shaft, which carries said damper plate, being operatively coupled to said gear sector, control circuit means operable to provide a first energizing circuit for said drive motor to effect rotation of said damper plate from said first position to said second position, a first limit switch connected in said first energizing circuit, a first actuator member carried by said gear sector for operating said first limit switch when said damper plate is rotated to said second position to interrupt said first energizing circuit to thereby effect the deenergization of said drive motor to maintain said damper plate at said second position, said control circuit means being further operable to provide a second energizing circuit for said drive motor to effect rotation of said damper plate from said second position to said first position, and a second limit switch connected in said second energizing circuit, a second actuator member carried by said gear sector for operating said second limit switch when said damper plate is rotated to said first position to interrupt said second energizing circuit to thereby effect the deenergization of said drive motor to maintain said damper plate at said first position.

4. In a heating system including a furnace having a fuel-fired burner apparatus, fuel supply means operable when energized to supply fuel to said burner apparatus for combustion, a vent stack for conducting combustion products away from said burner apparatus, and a damper plate pivotally mounted within said vent stack, said damper plate being normally maintained at a first position to close said vent stack and being rotatable to a second position to open said stack, a stack damper control arrangement comprising drive means operatively coupled to said damper plate, control circuit means operable to provide a first energizing circuit for said drive means to effect rotation of said damper plate from said first position to said second position, a first limit switch connected in said first energizing circuit and operated when said damper plate reaches said second position to interrupt said first energizing circuit to thereby effect the deenergization of said drive means when said damper plate reaches said second position, said control circuit means being further operable to provide a second energizing circuit for said drive means to effect rotation of said damper plate from said second position to said first position, and a second limit switch connected in said second energizing circuit and operated when said damper plate reaches said first position to interrupt said second energizing circuit to thereby effect the deenergization of said drive means when said damper plate reaches said first position, said first limit switch including first fixed contact means and first movable contact means mounted on a support means, and a first a actuator member, said first movable contact means normally engaging said first fixed contact means to complete said first energizing circuit when said damper plate is at said first position, and said second limit switch including second fixed contact means and second movable contact means mounted on said support means, and a second actuator member engaging said second movable contact means to maintain said second movable contact means disengaged from said second fixed contact means to interrupt said second energizing circuit when said damper plate is at said first position, said first actuator member being moved to engage said first movable contact means to move said first movable contact means out of engagement with said first fixed contact means when said damper plate is rotated to said second position, and said second actuator member being moved to disengage said second movable contact means to permit said second movable contact means to engage said second fixed contact means to prepare said second energizing circuit when said damper plate is rotated away from said first position.

5. A system as set forth in claim 4 wherein said first fixed contact means comprises a contact member having a first contact portion of an electrically conductive material, and at least one leg portion of an electrically conductive material for mounting said first contact portion on said support means in a spaced relationship with a surface of said support means, and wherein said first movable contact means comprises a leaf spring member of an electrically conductive material having a base portion secured to said surface of said support means, and a contact arm member extending at an angle to said surface of said support means adjacent said first contact portion, to engage said first contact portion when said damper plate is at said first position, and to be moved out of contact with actuator member when said damper plate is at said second position.

6. A system as set forth in claim 3 wherein said second fixed contact means comprises a further contact member having a third contact portion of an electrically conductive material and at least one leg portion of an electrically conductive material for mounting said third contact portion on said support means in a spaced relationship with said surface of said support means, said second movable contact means comprising a further leaf spring member of an electrically conductive material having a base portion secured to said surface of said support means, and a contact arm member extending at an angle to said surface of said support means adjacent said third contact portion to engage said third contact portion when said damper plate is at said first position and to be moved out of engagement with said third contact portion by said second actuator member when said damper plate is moved away from said first position.

7. A system as set forth in claim 3 wherein said first switch means includes a further leaf spring member having a base portion mounted on said surface of said support means and a contact arm member having an end contact portion extending adjacent an end contact portion of said leaf spring member of said first movable contact member in a spaced relationship therewith forming a gap there between, said first actuator member having electrically conductive material on a surface thereof which bridges said gap between said end contact portions of said leaf spring members when said drive means rotates said damper plate to said second position, to thereby complete an energizing circuit for said fuel-supply means of said system for supplying fuel to said burner apparatus.

8. In a heating system including a furnace having a fuel-fired burner apparatus, fuel supply valve means operable when energized to supply fuel to said burner apparatus for combustion, a vent stack for conducting combustion products away from said burner apparatus, and a damper plate pivotally mounted within said stack, said damper plate being normally maintained at a first position to close said stack, and being rotatable to a second position to open said stack, a control arrangement for controlling the positioning of said damper plate and for effecting energization of said valve means only when said damper plate is at said second position, said control arrangement comprising a drive motor and drive circuit means, including first and second limit switches for controlling the energization of said motor, said first limit switch having first and second contacts and a first movable contact means normally engaging said first contact to prepare a first energizing path for said drive motor, and a second limit switch having a third contact and a second movable contact means normally disengaged from said third contact and operable to engage said third contact to prepare a second energizing path for said drive motor, and control means responsive to a demand for heat to connect power to said drive circuit means for energizing said drive motor over said first energizing path to rotate said damper plate from said first position to said second position, said second movable contact means being operated as said damper plate is moved from said first position to engage said third contact to prepare said second energizing path for said drive motor, said first movable contact means being operated when said damper plate has been rotated to said second position to disengage said first contact and to engage said second contact to complete an energizing path for said valve means to effect the deenergization of said drive motor and the energization of said valve means over said second path, said control means being operable when the heating demand is met to deenergize said valve means and to cause said motor to be reenergized over said second path to cause said damper plate to be rotated from said second position to said first position, said first movable contact means being operated to disengage said second contact to interrupt said energizing path for said valve means as said damper plate is rotated away from said second position, and said second movable contact means being operated to disengage said third contact to interrupt said second path when said damper plate is rotated to said first position to deenergize said drive motor.

9. A system as set forth in claim 8 wherein said first movable contact means comprises a switch arm having a contact portion mounted in a spaced relationship with said second contact providing a gap therebetween, and a bridge contact movable to bridge the gap between said contact portion and second contact whenever said damper plate is moved to said second position.

10. A system as set forth in claim 8 wherein said fuel supply valve means comprises a pilot valve means operable where energized to supply fuel to a pilot burner apparatus and a main valve means operable when energized to supply fuel to a main burner apparatus, said pilot valve means being energized and deenergized in response to operation of said first switch.

11. A system as set forth in claim 10 wherein said pilot valve means has an inlet connected to a fuel source and an outlet connected to said pilot burner apparatus, and said main valve means has an inlet connected to an outlet of said pilot valve means and an outlet connected to said main burner apparatus whereby fuel is supplied to said main burner apparatus only when said pilot valve means and said main valve means are energized.

12. A system as set forth in claim 11 wherein said pilot valve means is deenergized by said first switch when said damper plate is rotated away from said second position, interrupting the supply of fuel to said main valve means and thus to said main burner apparatus.

13. In a heating system including a furnace having a fuel-fired burner apparatus, fuel supply valve means operable when energized to supply fuel to said burner apparatus for combustion, a vent stack for conducting combustion products away from said burner apparatus, and a damper plate pivotally mounted within said stack, said damper plate being normally maintained at a first position to close said stack, and being rotatable to a second position to open said stack, a control arrangement for controlling the positioning of said damper plate and for effecting energization of said valve means only when said damper plate is at said second position, said control arrangement comprising a reversible motor having a shaft operatively coupled to said damper plate, and drive circuit means, including said first and second switch means for controlling the energization of said motor, control means including normally open thermostatically controlled switch contacts, said first switch means being connected in a first series circuit with said switch contacts between said motor and a source of energizing potential, said switch contacts being operated to close in response to a demand for heat, for energizing said drive circuit means thereby effecting energization of said motor, to cause said motor shaft to be driven in one direction to rotate said damper plate from said first position to said second position, said first switch means being operated when said damper plate is rotated to said second position to deenergize said motor and to complete a second series circuit, including said valve means and said switch contacts, to permit the energization and the deenergization of said pilot valve means to be effected by said switch contacts in the event of failure of said motor while said damper plate is maintained at said second position, said drive circuit means further including a normally non-conducting controlled switching device connected in a third series circuit with said second switch means between said motor and said source of energizing potential, said second switch means being further connected in an enabling circuit for said controlled switching device, said second switch means being operated to prepare an energizing path for said motor when said damper plate is rotated from said first position, said enabling circuit being inhibited when said switch contacts are closed and enabled when said switch contacts open when the heating demand is met, enabling said controlled switching device to complete said third circuit path to thereby energize said motor to cause said motor shaft to be driven in the opposite direction to rotate said damper plate from said second position to said first position said first switch means being operated as said damper plate is rotated away from said second position to interrupt said second circuit, and said second switch means being operated when said damper plate reaches said first position to deenergize the motor.

14. A system as set forth in claim 13 wherein said circuit includes time delay means operable to delay the enabling of said controlled switching device for a time after said switch contacts open.

15. In a heating system including a furnace having a fuel-fired burner apparatus, fuel supply means operable when energized to supply fuel to said burner apparatus for combustion, a vent stack for conducting combustion products away from said burner apparatus, and a damper plate pivotally mounted within said vent stack, said damper plate being normally maintained at a first position to close said vent stack, and being rotatable to a second position to open said stack, a stack damper control arrangement comprising drive means operatively coupled to said damper plate, activate means, control circuit means including first means responsive to operation of said activate means in response to a request for heat for causing said drive means to rotate said damper plate from said first position to said second position and to cause energization of said fuel supply means when said damper plate reaches said second position, said activate means being operable to deenergize said fuel supply means when the heating demand has been met, said control circuit means including second means including normally disabled switching means operable when enabled to cause said drive means to rotate said damper plate from said second position to said first position, and timing means for delaying the enabling of said switching means for a predetermined time after said activate means operates to deenergize said fuel supply means.

* * * * *

UNITED STATES PATENT OFFICE

CERTIFICATE OF CORRECTION

PATENT NO. : 4,017,024

DATED : April 12, 1977

INVENTOR(S) : Martin Coiner Grostick and Thomas Edward Hayes

It is certified that error appears in the above-identified patent and that said Letters Patent are hereby corrected as shown below:

Column 12, line 10, "3" should be -- 5 --.

Column 12, line 28, "3" should be -- 5 --.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*